US006485588B1

(12) United States Patent
Swann

(10) Patent No.: US 6,485,588 B1
(45) Date of Patent: Nov. 26, 2002

(54) AUTOIGNITION MATERIAL ADDITIVE

(75) Inventor: Timothy A. Swann, Mesa, AZ (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/488,118

(22) Filed: Jan. 20, 2000

(51) Int. Cl.[7] ..... C06B 33/00; C06B 33/02
(52) U.S. Cl. ..... 149/37; 149/44
(58) Field of Search ..... 149/37–44

(56) References Cited

U.S. PATENT DOCUMENTS 4,880,483 A * 11/1989 Baldi ..... 149/6
5,431,103 A * 7/1995 Hock et al. ..... 102/287
5,464,699 A * 11/1995 Baldi ..... 428/607
5,542,688 A * 8/1996 Scheffee ..... 280/741
5,656,793 A * 8/1997 Ochi et al. ..... 149/22
5,739,460 A * 4/1998 Knowlton et al. ..... 102/324
5,763,821 A 6/1998 Wheatly ..... 149/19.5
5,827,996 A * 10/1998 Yoshida et al. ..... 149/45
5,834,679 A 11/1998 Seeger ..... 102/288
5,866,842 A * 2/1999 Wilson et al. ..... 149/19.6
5,959,242 A * 9/1999 Knowlton et al. ..... 149/38

OTHER PUBLICATIONS

Comprehensive Inorganic Chemistry, vol. III, pp. 1071 and 1094.*

* cited by examiner

*Primary Examiner*—Peter M. Poon
*Assistant Examiner*—Aileen J. Baker
(74) *Attorney, Agent, or Firm*—Tarolli, Sundheim, Covell, Tummino & Szabo L.L.P.

(57) ABSTRACT

An apparatus (12) for inflating an inflatable vehicle occupant protection device (14) comprises an inflator housing (20). A gas generating material (18) is within the inflator housing (20). The gas generating material (18), when ignited, generates a gas for inflating the vehicle occupant protection device (14). An autoignition material (24) is provided for igniting the gas generating material (18). The autoignition material (24) comprises an additive that has a ratio of absorptivity of incident radiation to emissivity of internal energy by radiation of at least about 10.

6 Claims, 2 Drawing Sheets

AUTOIGNITION MATERIAL ADDITIVE

FIELD OF THE INVENTION

The present invention relates to an apparatus for inflating an inflatable vehicle occupant protection device, and more particularly to an autoignition material for igniting a gas generating material.

BACKGROUND OF THE INVENTION

An inflatable vehicle occupant protection device, such as an air bag, is deployed upon the occurrence of a vehicle crash. The air bag is part of a vehicle occupant protection apparatus, which further includes a crash sensor and an inflator. The inflator includes a housing, a gas generating material in the housing, and an igniter. The igniter is actuated so as to ignite the gas generating material when the vehicle experiences a collision for which inflation of the air bag is desired to protect the vehicle occupant. As the body of gas generating material burns, it generates a volume of inflation gas. The inflation gas is directed into the air bag to inflate the air bag. When the air bag is inflated, it expands into the vehicle occupant compartment and helps to protect the vehicle occupant.

Inflator housings may be formed from lightweight materials, such as aluminum. These lightweight materials can lose strength at abnormally high temperatures, such as those reached in a vehicle fire. At temperatures experienced in a vehicle fire, the gas generating material may autoignite and produce inflation fluid at a pressure sufficient to cause the inflator housing to lose its structural integrity due to the reduced strength of the inflator housing material. To prevent such loss of structural integrity, inflators typically include an autoignition material that will autoignite and initiate combustion of the gas generating material at a temperature below that at which the material of the housing begins to lose a significant percentage of its strength.

SUMMARY OF THE INVENTION

The present invention is an apparatus for inflating an inflatable vehicle occupant protection device. The apparatus comprises an inflator housing. A gas generating material is within the inflator housing. The gas generating material, when ignited, generates a gas for inflating the vehicle occupant protection device. An autoignition material is provided for igniting the gas generating material. The autoignition material comprises an additive that has a ratio of absorptivity of incident radiation to emissivity of internal energy by radiation of at least about 10.

Additionally, the present invention is an autoignition material for igniting a gas generating material comprising an additive that has a ratio of absorptivity of incident radiant energy to emissivity of internal energy by radiation of at least about 10.

BRIEF DESCRIPTION OF THE DRAWINGS

Further features of the present invention will become apparent to those skilled in the art to which the present invention relates from reading the following description with reference to the accompanying drawings, in which.

DESCRIPTION OF A PREFERRED EMBODIMENT

Figure 1:
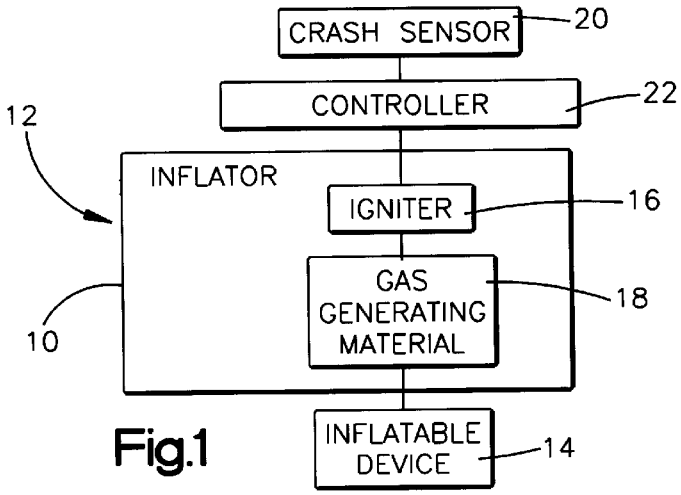
FIG. 1 is a schematic view of a vehicle occupant protection apparatus including an inflator constructed in accordance with the present invention.

As representative of the present invention, FIG. 1 illustrates schematically an inflator 10, which forms part of a vehicle occupant protection apparatus 12. The apparatus 12 includes an inflatable vehicle occupant protection device 14. In the preferred embodiment of the invention, the protection device 14 is an air bag. Other inflatable vehicle occupant protection devices that can be used in accordance with the present invention include, for example, inflatable seat belts, inflatable knee bolsters, inflatable head liners, inflatable side curtains, and knee bolsters operated by inflatable air bags.

The inflator 10 comprises an igniter 16. The igniter 16 is electrically actuatable to ignite a source of inflation fluid, such as a gas generating material 18. Combustion of the gas generating material 18 produces a combustion gas that inflates the air bag 14. When the air bag 14 is inflated, it extends into a vehicle occupant compartment (not shown) to help protect a vehicle occupant from a forceful impact with parts of the vehicle as a result of a crash.

The apparatus 12 also includes a crash sensor 20. The crash sensor 20 is a known device that senses sudden vehicle deceleration. The magnitude and duration of the deceleration are measured by the crash sensor 20. If the magnitude and duration of the deceleration meet or exceed predetermined threshold levels, they indicate the occurrence of a crash having at least a predetermined threshold level of crash severity. A deployment signal is then transmitted to a controller 22. The controller 22 sends an actuation signal to the inflator 10 to actuate the inflator.

Figure 2:
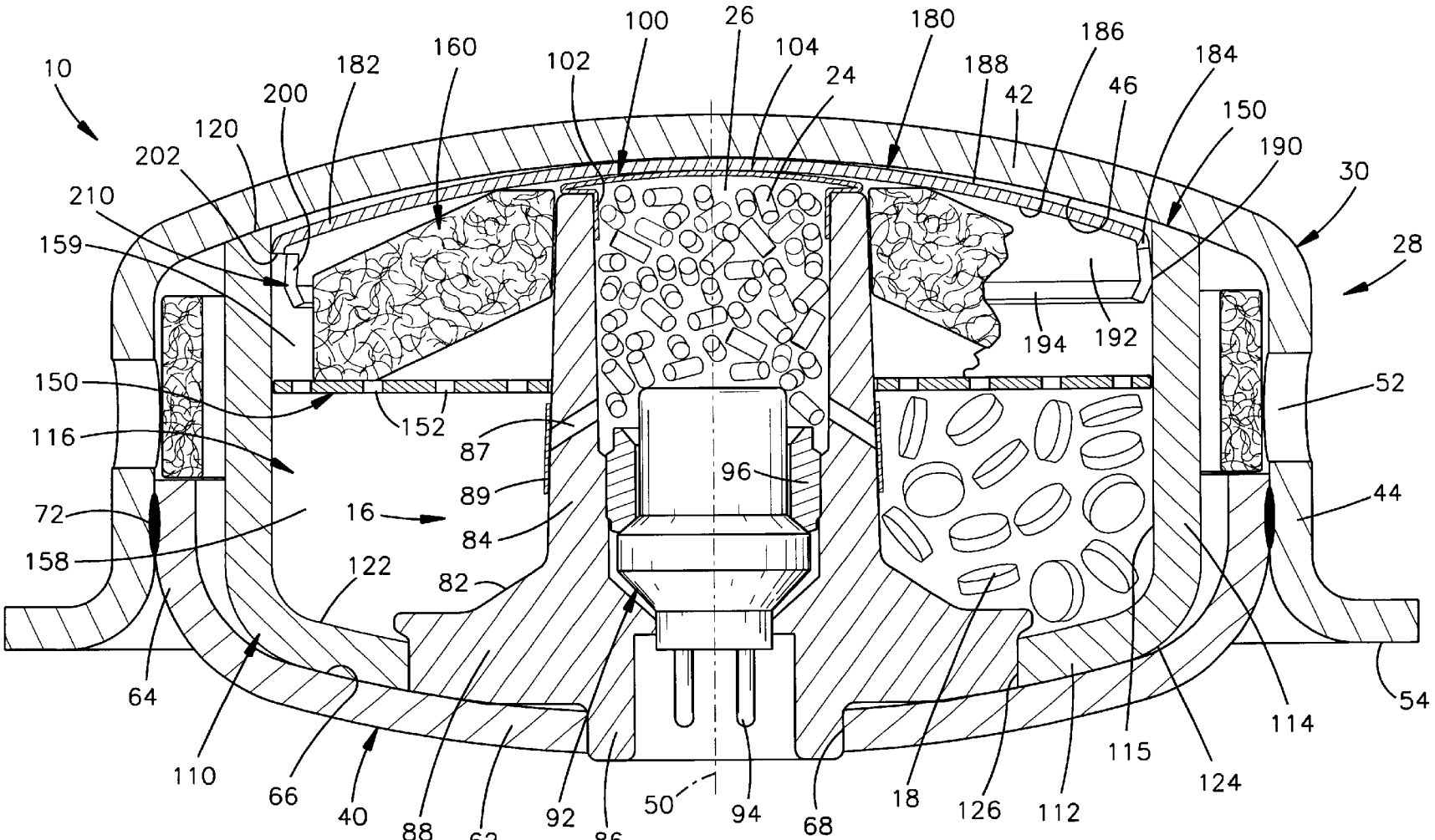
FIG. 2 is a sectional view showing the inflator of FIG. 1 in an unactuated condition.

In accordance with the present invention, the igniter 16 comprises an autoignition material 24 (FIG. 2). The autoignition material 24 is contained in an ignition chamber 26 of the igniter 16. The autoignition material 24 generates, upon ignition, heat and combustion products, which ignite the gas generating material 18. The autoignition material 24 will spontaneously ignite at a predetermined temperature. The predetermined temperature is below the temperature at which the inflator 10 begins to lose structural integrity and below the temperature at which the gas generating material 18 normally ignites. Preferably, the autoignition material 24 is thermally stable up to 110° C. and ignites rapidly at temperatures between about 150° C. and 175° C.

The autoignition material 24 comprises an intimate mixture of an oxidizer, a fuel and an additive. The oxidizer of the autoignition material 24 is an inorganic oxidizer, such as inorganic salt, a metal oxide, or a mixture of an inorganic salt and a metal oxide. The inorganic salt oxidizer and metal oxide of the present invention can be any inorganic salt oxidizer or metal oxide commonly used in an autoignition material for an inflator.

Examples of inorganic salt oxidizers are nitrates of alkali metal or alkaline earth metals, such as potassium nitrate, sodium nitrate, strontium nitrate, and barium nitrate, perchlorates of alkali metals or alkaline earth metals, such as potassium perchlorate and sodium perchlorate, chlorates of alkali metal or alkaline earth metals, such as potassium chlorate, sodium chlorate, strontium chlorate, and barium chlorate, ammonium nitrate, ammonium perchlorate, ammonium chlorate, silver nitrate, silver nitrite, complex salt nitrate, such as ceric ammonium nitrate or zirconium oxide dinitrate, boron potassium nitrate, or mixtures thereof.

Examples of metal oxides are transition metal oxides, such-as copper oxide (CuO), nickel oxide (NiO), iron oxide ($Fe_2O_3$), and zirconium oxide ($ZrO_2$).

The amount of oxidizer in the autoignition material 24 is that amount necessary to achieve sustained combustion of the autoignition material 24 upon ignition of the autoignition material 24. A preferred amount is about 20% to about 60% by weight of the autoignition material 24.

The fuel used in the autoignition material 24 of the present invention can be a flammable metal, a metal complex, a high nitrogen containing organic compound, or a mixture thereof. Examples of flammable metals are magnesium, aluminum, titanium, strontium, zirconium, and molybdenum. Examples of metal complexes are potassium dinitrobenzofuroxan, barium styphnate, lead azide, lead thiocyanate, or lead styphnate. Examples of high nitrogen organic fuel are nitrocellulose, nitroglycerine, diazidodinitrophenol, 1,1-diamino-3,3,5,5-tetraazidotriphosphazine, cyanamides, tetrazoles, carbonamides, triazoles, guanidine, derivatives of guanidine, tetramethyl ammonium nitrate, urea, salts of urea, nitramines, and mixtures thereof.

The amount of fuel in the autoignition material 24 is that amount necessary to achieve sustained combustion of the autoignition material 24 upon ignition of the autoignition material 24. A preferred amount of fuel is about 20% to about 50% by weight of the autoignition material 24.

The ratio of oxidizer to fuel in the autoignition material 24 is that ratio necessary to achieve spontaneous autoignition of the autoignition material 24 at the predetermined temperature.

The autoignition material 24 of the present invention further comprises an additive. The additive is a material that has a high ratio of absorptivity (A) of incident radiant energy to emissivity (E) of internal energy by radiation (i.e. a high A/E ratio material). Preferably, the high A/E ratio material has a ratio of absorptivity of incident radiant energy to emissivity of internal energy by radiation of at least about 10. Materials with a ratio of absorptivity to emissivity of at least about 10 readily absorb thermal radiation but do not emit the absorbed thermal radiation and/or internal energy as thermal radiation. As a result, thermal radiation that is absorbed by the high A/E ratio material is converted to thermal energy, which is conducted to the oxidizer and/or fuel that is in thermal contact with the high A/E ratio material.

When a vehicle fire occurs, thermal energy from the fire, as is comes close to the inflator 10, is absorbed by the high A/E ratio material. This thermal energy increases the temperature of the autoignition material 24 an effective amount to cause the autoignition material 24 to ignite at the predetermined temperature below the temperature at which the inflator begins to lose structural integrity and below the temperature at which the gas generating material normally ignites. Ignition of the autoignition material causes the gas generating material to ignite. Thus, the gas generating material burns at a temperature below the temperature at which the inflator 10 begins to lose structural integrity.

The amount of high A/E ratio material in the autoignition material 24 is that amount effective to improve the radiant energy absorption of the autoignition material 24. A preferred amount of high A/E ratio material is about 1% to about 20% by volume of the autoignition material.

Preferred materials with a ratio of absorptivity to emissivity of at least about 10 include nickelic oxide ($Ni_2O_3$), chromium dioxide ($CrO_2$), cobalto-cobaltic oxide ($Co_3O_4$), and cobaltic oxide ($Co_2O_3$) These materials are preferred because they are oxidizers and can be used to supplement the oxidizer of present invention. Moreover, these materials have a catalytic effect of lowering the energy of activation of the autoignition material.

The high A/E ratio material is incorporated into the autoignition material 24 in the form of finely divided particles. The average particle size of the high A/E ratio material is preferably about 10 $\mu$m to about 50 $\mu$m.

The autoignition material 24 may comprise other ingredients commonly added to autoignition materials. Such ingredients include binders, process aids, and ignition aids, all in relatively small amounts.

The autoignition material 24 can be prepared by mixing particles of the oxidizer with particles of the fuel, particles of the high A/E ratio material and other ingredients, if used, in a conventional mixing device. The mixture is compacted into the configuration of a cylindrical pellet or into some other desired configuration.

Optionally, the particles of oxidizer, the particles of fuel, and the particles of high A/E ratio material (and other ingredients, if used) may be mixed with a liquid to form a liquid slurry. The liquid slurry is dried, and the dried mixture is compacted into the configuration of a cylindrical pellet or into some other desired configuration.

Figure 3:
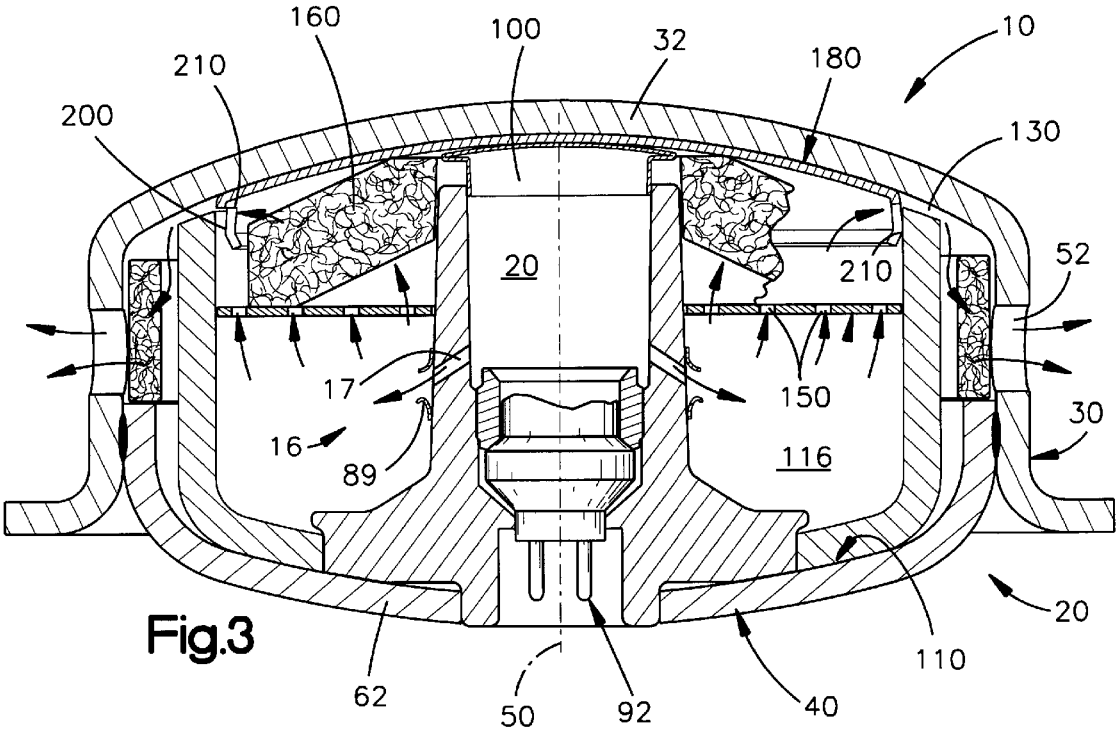
FIG. 3 is a view similar to FIG. 2, showing the inflator in an actuated condition.

A type of apparatus in which the autoignition material 24 of the present invention is particularly useful is illustrated in FIGS. 2 and 3. Referring to FIGS. 2 and 3, the inflator 10 includes a generally cylindrical housing or shell 28. The inflator 10 has a circular configuration as seen from above in FIGS. 2 and 3. The housing 28 includes a first or upper (as viewed in the drawings) housing part 30, referred to herein as a diffuser, and a second or lower (as viewed in the drawings) housing part 40, referred to herein as a closure.

The diffuser 30 has an inverted, cup-shaped configuration including a radially extending end wall 42 and an axially extending side wall 44. The end wall 42 of the diffuser 30 is domed, that is, has a curved configuration projecting away from the closure 40. The end wall 42 has an inner side surface 46.

The side wall 44 of the upper housing part 30 has a cylindrical configuration centered on an axis 50 of the inflator 10. A plurality of inflation fluid outlets 52 are disposed in a circular array on the side wall 44. Each one of the inflation fluid outlets 52 extends radially through the side wall 44. The outlets 52 enable flow of inflation fluid out of the inflator 10 to inflate the air bag 14. The outlets 52, as a group, have a fixed, predetermined flow area. An annular inflator mounting flange 54 extends radially outward from the side wall 44 at a location below (as viewed in FIG. 2) the inflation fluid outlets 52.

The closure 40 has a cup-shaped configuration including a radially extending end wall 62 and an axially extending side wall 64. The end wall 62 of the closure 40 is domed, that is, has a curved configuration projecting away from the upper housing part 30. The end wall 62 has an inner side surface 66 presented toward the end wall 42 of the upper housing part 30. A circular opening 68 in the end wall 62 is centered on the axis 50.

The side wall 64 of the closure 40 has a cylindrical configuration centered on the axis 50. The outer diameter of the side wall 64 of the closure 40 is approximately equal to the inner diameter of the side wall 44 of the diffuser 30. The closure 40 is nested inside the diffuser 30, as seen in FIG. 2. The side wall 64 of the closure 40 is welded to the side wall 44 of diffuser 30 with a single, continuous weld 72.

The igniter 16 includes an igniter housing 82. The igniter housing 82 has a generally tubular configuration, including a tapered, axially extending side wall 84, an end portion 86, and a flange 88. The ignition chamber 26 is radially inward of the side wall 84. A circular array of ports or passages 87 is formed in the side wall 84. The passages 87 extend between the ignition chamber 26 and the exterior of the igniter housing 82. The radially outer ends of the passages 87 are covered by adhesive foil 89. The end portion 86 of the igniter housing 82 is disposed at one end of the side wall 84 and extends into the central opening 68 in the end wall 62 of the closure 40.

The igniter 16 includes an initiator 92. The initiator 92 is a known device that is electrically actuatable by an electric current applied through terminals 94 to generate combustion products. A sleeve 96 is press fit between the initiator 92 and the side wall 84 of the igniter housing 82 to secure the initiator in position in the housing 82.

The igniter 16 also includes a metal igniter cap 100 on the upper end of the igniter housing 82. The igniter cap 100 has an axially extending, cylindrical portion 102, which is press fit inside the side wall 84 of the igniter housing 82. A radially extending end wall 104 of the igniter cap 100 extends across and closes the ignition chamber 26 in the igniter housing 82.

The flange 88 of the igniter housing 82 extends radially outward from the side wall 84 of the igniter housing. The flange 88 overlies the radially inner portion of the end wall 62 of the closure 40. If desired, a seal (not shown), such as a gasket or a layer of sealant material, may be provided between the flange 88 of the igniter housing 82 and the end wall 62 of the closure 40.

The inflator 10 includes a first flow control member in the form of a combustion cup 110. The combustion cup 110 has an annular configuration including a radially extending lower end wall 112 and an axially extending side wall 114. The side wall 114 has an inner side surface 115. A ring-shaped propellant combustion chamber 116 is defined inside the combustion cup 110. The radially outer boundary of the combustion chamber 116 is the side wall 114 of the combustion cup 110. The radially. inner boundary of the combustion chamber 116 is the side wall 84 of the igniter housing 82.

The side wall 114 of the combustion cup 110 is disposed radially inward of the side walls 44 and 64 of the diffuser 30 and closure 40, respectively. The combustion cup side wall 114 has a ring-shaped upper end surface 120. The upper end surface 120 has a generally frustoconical configuration, which seals against the inner side surface 46 of the end wall 42 of the diffuser 30.

The lower end wall 112 of the combustion cup 110 extends radially inward from the lower portion of the side wall 114 of the combustion cup. The lower end wall 112 has an inner side surface 122, which is presented toward the diffuser 30. The lower end wall 112 has an outer side surface 124, which is in abutting engagement with the inner side surface 66 of the end wall 62 of the closure 40. The axial length of the combustion cup 110 is selected so that the combustion cup is trapped or captured axially between the diffuser 30 and the closure 40.

The upper end surface 120 of the combustion cup side wall 114 and the inner side surface 46 of the diffuser 30 define a fluid passage 130 (FIG. 3) in the inflator 10. Because the combustion cup side wall 114 is cylindrical, the fluid passage 130 has an annular configuration extending around and centered on the axis 50. The fluid passage 130 is located between the combustion chamber 116 and the fluid outlets 52. The fluid passage 130, which is normally closed, opens upon combustion of the gas generating material 18.

The lower end wall 112 of the combustion cup 110 has a ring-shaped end surface 126. The end surface 126 of the lower end wall 112 of the combustion cup 110 is disposed adjacent to the flange 88 of the igniter housing 82. The igniter housing 82 helps to locate the combustion cup 110 radially in the inflator 10.

The gas generating material 18 is located in the combustion chamber 116 in the combustion cup 110. The gas generating material 18 is a known material that is ignitable by the igniter 16 and that, when ignited, produces inflation fluid in the form of gas under pressure for inflating the air bag 14. The gas generating material 18 is illustrated as being provided in the form of discs. (For clarity in FIG. 2, the gas generating material discs are not shown in some areas of the combustion chamber 116.) The gas generating material 18 could, alternatively, be provided in the form of pellets or tablets, or as large discs encircling the igniter housing 82.

The inflator 10 includes a gas generating material retainer 150 in the combustion chamber 116. The gas generating material retainer 150 is a ring-shaped metal plate having a plurality of perforations 152. The gas generating material retainer 150 is disposed in the combustion chamber 116 and extends radially between the side wall 84 of the igniter housing 82 and the side wall 114 of the combustion cup 110. The gas generating material retainer 150 divides the combustion chamber 116 into an annular first part 158, located between the retainer and the closure 40, and an annular second part 159, located between the retainer and the diffuser 30.

The inflator 10 also includes a combustor heat sink 160 in the combustion chamber 116. The heat sink 160 has an annular configuration extending around an upper end portion of the side wall 84 of the igniter housing 82. The heat sink 160 is formed as a knitted stainless steel wire tube that is compressed to the frustoconical shape illustrated in the drawings.

The inflator 10 includes a second fluid flow control member in the form of a threshold cap 180. The threshold cap 180 is disposed in the combustion chamber 116, and is located axially between the igniter cap 100 and the diffuser 30. The threshold cap 180 is made from stamped sheet metal, preferably aluminum, substantially thinner than the housing parts 30 and 40.

The threshold cap 180 (FIG. 2) is shaped generally like a throwing disc and has a domed main body portion or central wall 182 centered on the axis 50. The central wall 182 has a circular configuration including an annular outer edge portion 184. The central wall 182 has parallel inner and outer side surfaces 186 and 188.

An annular side wall 190 of the threshold cap 180 extends generally axially from the central wall 182. The side wall 190 of the threshold cap 180 includes a first portion 192, which is connected with and extends from the outer edge portion 184 of the central wall 182 of the threshold cap. The first portion 192 has a slightly frustoconical configuration, extending radially outward from the central wall 182 as it extends axially away from the central wall 182. In the illustrated embodiment, the first portion 192 of the side wall 190 extends at a small angle (about 5 degrees) to the axis 50. A second portion 194 of the side wall 190 of the threshold cap 180 extends axially downward and radially inward from the first portion 192.

The threshold cap 180 has a plurality of openings in the form of slots 200. The slots 200 extend between the inner and outer side surfaces of the side wall 190 of the threshold cap 180. The slots 200 are spaced apart equally along the side wall 190, in a circular array centered on the axis 50. Each one of the slots 200 has a respective upper edge 202.

The slots 200 in the threshold cap 180 together form a fluid flow control passage 210 in the threshold cap. In the illustrated embodiment, the threshold cap 180 has six slots 200. A greater or lesser number of slots 200 may be provided to obtain the desired flow control characteristics of the inflator 10.

The threshold cap 180 (FIG. 2) is disposed in the combustion chamber 116 in the inflator 10, at a location centered on the axis 50. The inner side surface 186 of the central wall 182 of the threshold cap 180 is in abutting engagement with the end wall 104 of the igniter cap 100. The central portion of the outer side surface 188 of the central wall 182 of the threshold cap 180 is in abutting engagement with the inner side surface 46 of the central wall 42 of the diffuser 30.

The threshold cap 180 extends across the entire combustion chamber 116 of the inflator 10. The outer side surface of the side wall 190 of the threshold cap 180 is in abutting engagement with the inner side surface 115 of the side wall 114 of the combustion cup 110, near the fluid passage 130.

The combustor heat sink 160 is compressed axially between the threshold cap 180 and the gas generating material retainer 150. The combustor heat sink 160 acts as a spring, pressing the gas generating material retainer 150 against the gas generating material 18. The combustor heat sink 160 holds the gas generating material retainer 150 from vibrating. The conical shape of the heat sink 160 makes the heat sink resilient. The resilience of the heat sink 160 eliminates deformation of the parts of the inflator 10 and crushing of the gas generating material 18 during assembly.

The igniter 16 is trapped or captured axially between the threshold cap 180 and the closure 40. Specifically, the distance between the igniter cap 100 and the flange 88 of the igniter housing 82 is selected so that, when the housing parts 30 and 40 are welded together with the igniter 16 inside, the end wall 104 of the igniter cap engages the inner side surface 186 of the central wall 182 of the threshold cap 180. The igniter housing 82 is pressed axially into engagement with the closure 40. The flange 88 of the igniter housing 82 is pressed axially outward against or toward the end wall 62 of the closure 40.

Upon exposure of the inflator 10 to an abnormally high temperature, such as that experienced in a vehicle fire, the temperature of the metal diffuser 30 increases. The diffuser 30 is in direct thermal contact with threshold cap 180. The threshold cap 180 is in direct thermal contact with the igniter cap 100. The igniter cap 100 is in direct thermal contact with the side wall 84 of the igniter housing 82. As a result, heat from the diffuser is conducted to the igniter cap 100 and the side wall 84 of the igniter housing 82.

As the temperature of the igniter cap 100 and the side wall 84 of the igniter housing 82 increases, heat is transferred by conduction from the igniter cap 100 and the side wall 84 to the autoignition material 24 which is in direct thermal contact with the igniter cap 100 and/or side wall 84. Heat is also transferred by thermal radiation from the igniter cap 100 and the side wall 84 to the autoignition material 24. Thermal radiation emitted by the igniter cap 100 and the side wall 84 is readily absorbed by the particles of high A/E ratio material in the autoignition material 24 exposed to the thermal radiation. The temperature of the particles of high A/E ratio material exposed to the thermal radiation and to the conducted heat rapidly increases because the particles of high A/E ratio do not readily lose energy by thermal radiation. Instead, the thermal radiation and conducted heat absorbed by the particles is converted to heat, which is conducted to the fuel and oxidizer of the autoignition material 24.

The overall heat gain of the autoignition material 24 is quickly increased. When the temperature of the autoignition material 24 reaches the predetermined temperature, the autoignition material 24 ignites and produces combustion products and heat. The combustion products and heat cause the foil 89 to rupture. The combustion products flow through the passages 87 and into the combustion chamber 116, as indicated by the arrows in FIG. 3.

The combustion products flowing into the combustion chamber 116 ignite the gas generating material 18. The gas generating material 18 combusts and produces inflation fluid under pressure in the combustion chamber 116. The pressure in the combustion chamber 116 rises rapidly to a pressure in the range of about 1,000 psi to about 2,000 psi or more.

At these pressures, the inflator 10 could lose its structural integrity if the material of the inflator 10 were at an abnormally high temperature. The inflator does not lose its structural integrity, however, because the combustion has occurred at the predetermined temperature, which is below the temperature at which the material of the inflator loses a significant percentage of its strength.

The inflation fluid flows out of the combustion chamber 116, through the slots 200 in the threshold cap 180, and toward the fluid passage 130. Inflation fluid flows through the fluid passage 130, through a final filter, and toward the inflation fluid outlets 52. The inflation fluid flows out of the combustion chamber 116 along the entire 360° extent of the fluid passage 130. The fluid outlets 52 direct the inflation fluid to flow out of the housing 20 to the inflatable device 14.

The autoignition material 24 of the present invention is not intended to be limited to an inflator formed from lightweight materials that can lose strength at abnormally high temperatures reached in a vehicle fire. The autoignition material 24 may be used in other inflators or vehicle occupant protection apparatuses such as an inflator formed from high strength materials that would not lose strength at abnormally high temperatures reached in a vehicle fire.

From the above description of the invention, those skilled in the art will perceive improvements, changes and modifications. Such improvements, changes and modifications within the skill of the art are intended to be covered by the appended claims.

Having described the invention, the following is claimed:

1. An autoignition material for igniting a gas generating material, said autoignition material comprising an intimate mixture of an oxidizer, a fuel, and an additive, said additive having a ratio of absorptivity of incident radiant energy to emissivity of internal energy by radiation of at least about 10, wherein the amount of additive is that amount effective to improve the radiant energy absorption of said autoignition material and wherein said additive is selected from the group consisting of nickelic oxide ($Ni_2O_3$), chromium dioxide ($CrO_2$), and cobaltic oxide ($Co_2O_3$), the autoignition temperature of said autoignition material being from about 150° C. to about 175° C.

2. The autoignition material of claim 1 wherein the amount of the additive is from about 1% to about 20% by volume of the autoignition material.

3. The autoignition material of claim 1 wherein the autoignition material has an autoignition temperature below the autoignition temperature of the gas generating material.

4. The autoignition material of claim 1 wherein the oxidizer is an inorganic salt, a metal oxide, or a mixture of an inorganic salt and a metal oxide.

5. The autoignition material of claim 1 wherein the fuel is a flammable metal, a metal complex, a high nitrogen containing organic compound, or a mixture thereof.

6. An autoignition material for igniting a gas generating material, said autoignition material comprising an intimate mixture of an oxidizer, a fuel, and an additive, said additive having a ratio of absorptivity of incident radiant energy to emissivity of internal energy by radiation of at least about 10, wherein the amount of additive is that amount effective to improve the radiant energy absorption of said autoignition material, wherein said additive consists of nickelic oxide ($Ni_2O_3$), the autoignition temperature of said autoignition material being from about 150° C. to about 175° C.

* * * * *